US010166658B2

(12) United States Patent
Bennett et al.

(10) Patent No.: US 10,166,658 B2
(45) Date of Patent: Jan. 1, 2019

(54) MULTI-PURPOSE WRENCH FOR SERVICING A FIREARM

(71) Applicant: Magpul Industries Corp., Austin, TX (US)

(72) Inventors: William Bradley Bennett, Lafayette, CO (US); Michael T. Mayberry, Denver, CO (US); Jeremy Fiester, Lafayette, CO (US); Lance Johnston, Firestone, CO (US); Jonathan Cross, Longmont, CO (US); Brian L. Nakayama, Arvada, CO (US)

(73) Assignee: Magpul Industries Corp., Austin, TX (US)

( * ) Notice: Subject to any disclaimer, the term of this patent is extended or adjusted under 35 U.S.C. 154(b) by 547 days.

(21) Appl. No.: 14/687,458

(22) Filed: Apr. 15, 2015

(65) Prior Publication Data

US 2015/0290780 A1 Oct. 15, 2015

Related U.S. Application Data

(60) Provisional application No. 61/979,926, filed on Apr. 15, 2014.

(51) Int. Cl.

| | |
|---|---|
| ***B25B 13/50*** | (2006.01) |
| ***B25B 13/04*** | (2006.01) |
| ***B25B 13/08*** | (2006.01) |
| ***B25B 13/02*** | (2006.01) |
| ***B25B 13/48*** | (2006.01) |
| ***F41A 35/00*** | (2006.01) |

(52) U.S. Cl.

CPC ..... *B25B 13/50* (2013.01); *B25B 13/02* (2013.01); *B25B 13/04* (2013.01); *B25B 13/08* (2013.01); *B25B 13/48* (2013.01); *F41A 35/00* (2013.01)

(58) Field of Classification Search

CPC ..... B25B 13/48; B25B 13/50; B25B 13/08; B25B 13/04; B25B 13/06; B25F 1/00; B25F 1/003; B25F 3/00

USPC ..... 81/177.7, 177.8, 177.9, 176.1, 176.15; D8/17

See application file for complete search history.

(56) References Cited

U.S. PATENT DOCUMENTS 2,716,367 A * 8/1955 Montgomery ..... B25B 13/04 81/124.3

D175,493 S * 9/1955 Brame ..... D8/27

(Continued)

OTHER PUBLICATIONS

Geissele Automatics, "AR15/M4 Reaction Rod", Webpage found at http://geissele.com/reaction-rod.html Inventor(s) aware of prior art on or before Apr. 29, 2015, p. 2 Published in: US.

Crosstac, "CrossTac Armorer's Action Block and Hammer Block AR-15", Webpage found at http://www.midwayusa.com/product/698333/crosstac-armorers-action-block-and-hammer-block-ar-15, aware of prior art on or before Apr. 30, 2014, p. 3 Published in: US.

(Continued)

*Primary Examiner* — Christopher M Koehler
*Assistant Examiner* — Seahee Yoon
(74) *Attorney, Agent, or Firm* — Neugeboren O'Dowd PC

(57) ABSTRACT

A wrench and a method for performing gunsmithing operations is disclosed. The wrench may have a first end and a second end. The first end may have an integrated two-sided castle nut and flash hider wrench aperture, and the second end may have a tool interface. The aperture may have a plurality of raised elements for engaging indentations in a castle nut, each of the raised elements extending at least one of inwardly from a wall section of the aperture and upwardly from a first face of the wrench. The aperture may have a flash hider cutout portion.

16 Claims, 11 Drawing Sheets

(56) References Cited

U.S. PATENT DOCUMENTS

| | | | | |
|---|---|---|---|---|
| 2,801,561 | A * | 8/1957 | Bonner | B25B 13/04 81/124.3 |
| 2,830,480 | A * | 4/1958 | Brame | B25B 13/02 81/176.15 |
| 4,862,544 | A | 9/1989 | Wallace | |
| 4,873,777 | A | 10/1989 | Southard | |
| 4,901,411 | A | 2/1990 | Chestnut et al. | |
| 5,307,713 | A * | 5/1994 | White | B25B 13/08 81/119 |
| 6,138,533 | A * | 10/2000 | Turtle | B25B 23/0021 403/157 |
| 7,117,770 | B2 * | 10/2006 | Hsien | B25B 13/08 81/186 |
| 7,159,491 | B1 * | 1/2007 | Chaconas | B25B 13/06 81/124.3 |
| 7,204,174 | B1 * | 4/2007 | Wood | B25B 13/481 81/125 |
| D548,552 | S * | 8/2007 | Elkaim | F41A 35/00 D22/199 |
| D564,316 | S | 3/2008 | Elkaim | |
| D598,723 | S * | 8/2009 | Cheng | D8/17 |
| D601,393 | S | 10/2009 | Cui | |
| 7,637,049 | B1 | 12/2009 | Samson et al. | |
| 7,861,621 | B2 * | 1/2011 | Cheng | B25B 13/04 81/121.1 |
| 8,091,266 | B2 | 1/2012 | Huang | |
| 8,209,896 | B1 | 6/2012 | Cashwell | |
| 8,322,068 | B2 | 12/2012 | Wilson | |
| 8,479,404 | B1 | 7/2013 | Samson et al. | |
| 8,572,884 | B1 | 11/2013 | Saur | |
| 8,590,203 | B1 | 11/2013 | McCarthy et al. | |
| D703,502 | S * | 4/2014 | Cheng | D8/21 |
| 8,931,201 | B2 | 1/2015 | Gianladis et al. | |
| 2004/0074346 | A1 * | 4/2004 | Schmidt | B25B 13/02 81/176.15 |
| 2006/0218840 | A1 | 10/2006 | Cauley | |
| 2009/0199345 | A1 | 8/2009 | Morgan | |
| 2010/0000378 | A1 * | 1/2010 | Hart | B25B 13/04 81/124.4 |
| 2010/0281748 | A1 | 11/2010 | Parry et al. | |
| 2012/0110745 | A1 | 5/2012 | Hanlon | |
| 2012/0125162 | A1 * | 5/2012 | Nguyen | B23B 31/201 81/124.4 |
| 2012/0222344 | A1 | 9/2012 | Werner | |
| 2012/0255212 | A1 | 10/2012 | Werner | |
| 2012/0291595 | A1 | 11/2012 | Hemesath | |
| 2013/0047483 | A1 | 2/2013 | Horne | |
| 2013/0192005 | A1 | 8/2013 | Christenson | |

OTHER PUBLICATIONS

DPMS, "DPMS the Flipper Action Block AR-15 Delrin", Webpage found at http://www.midwayusa.com/product/684804/dpms-the-flipper-action-block-ar-15-delrin, aware of prior art on or before Apr. 30, 2014, p. 2, Published in: US.

Brownells, "AR15/M16 Barrel Extension Torque Tools", Webpage found at http://www.brownells.com/gunsmith-tools-supplies/rifle-tools/barrel-tools/ar-15-m16-barrel-extension-torque-tools-prod27452.aspx Inventor(s) aware of prior art on or before Apr. 29, 2015, p. 2, Published in: US.

Wheeler, "Wheeler Engineering AR-15 Mag Well Vise Block", Webpage found at http://www.cheaperthandirt.com/product/9-90652 aware of prior art on or before Apr. 28, 2014, aware of prior art on or before Apr. 30, 2014, p. 2 Published in: US.

Wheeler, "Wheeler Engineering Delta Series AR Armorers Vise", Webpage found at http://www.midwayusa.com/product/865390/wheeler-engineering-delta-series-ar-armorers-vise, aware of prior art on or before Apr. 30, 2014, p. 3, Published in: US.

Wheeler, "Wheeler Engineering Delta Series Adjustable Receiver Link AR-15", Webpage found at http://www.midwayusa.com/product/774225/wheeler-engineering-delta-series-adjustable-receiver-link-ar-15, aware of prior art on or before Apr. 30, 2014, p. 2, Published in: US.

Wheeler, "Wheeler Delta AR-15 Upper Vise Block Clamp", Webpage found at http://www.midwayusa.com/product/210021/wheeler-engineering-delta-series-upper-receiver-vise-block-clamp-ar-15 aware of prior art on Apr. 30, 2014, p. 3, Published in: US.

Brownells, "AR-15/M16 Combination Wrench", Webpage found at http://www.brownells.com/gunsmith-tools-supplies/rifle-tools/wrenches/ar-15-m16-combination-wrench-prod468.aspx Inventor(s) aware of prior art on or before Apr. 29, 2015 , p. 2, Published in: US.

Midway USA, "DPMS Multi-Tool AR-15 Steel", Webpage found at http://www.midwayusa.com/product/885858/dpms-multi-tool-ar-15-steel Inventor(s) aware of prior art on or before Apr. 29, 2015, p. 2, Published in: US.

Gem State Armory, "AR Armorers Wrench", Webpage found at http://www.gem-state-armory.com/ar-armorers-wrench/ Inventor(s) aware of prior art on or before Apr. 29, 2015, p. 2, Published in: US.

NcStar, "NcStar AR15 Combo Armorer's Wrench Tool", Webpage found at http://www.amazon.com/NcStar-Armorers-Wrench-powder-coated/dp/B00238XECI Inventor(s) aware of prior art on or before Apr. 29, 2015, p. 6, Published in: US.

Tapco, "AR Armorer's Tool", Webpage found at http://www.tapco.com/products/ar/index.php?_a=viewProd&productId=350 Inventor(s) aware of prior art on or before Apr. 29, 2015, p. 1, Published in: US.

* cited by examiner

MULTI-PURPOSE WRENCH FOR SERVICING A FIREARM

CROSS-REFERENCE TO RELATED APPLICATIONS

This application claims benefit to U.S. Provisional Application No. 61/979,926 filed Apr. 15, 2014 and entitled "MULTI-PURPOSE WRENCH FOR SERVICING A FIREARM," the entire disclosure of which is hereby incorporated by reference for all purposes, as if fully set forth herein.

FIELD OF THE DISCLOSURE

The present disclosure relates generally to gunsmithing and more particularly to a multi-purpose wrench for servicing a firearm.

BACKGROUND OF THE INVENTION

Users of military and civilian AR15/M16 or M4 type weapons have numerous accessory options for customizing, repairing, and enhancing these firearms. Such accessories include barrels, flash hiders, sling attachments, handguards, rails, sights, and stocks, among others. Installation of some or all of these accessories or replacement components requires several specifically shaped tools in order to remove and later reengage integral attachments such as barrel nuts, castle nuts, and flash hiders, each of which can be notoriously difficult to remove and should be tightly reengaged so that firing vibration and handling does not jar these components loose. Users, such as professional gunsmiths and hobbyists, looking to remove or reengage a barrel nut, castle nut, or flash hider, require a tool able to apply a great deal of torque. Wrenches can provide high torque when a component aperture is located on an end of an elongate wrench. Previous wrench designs have combined a barrel nut aperture on one end and a castle nut aperture on another end, and sometimes have included a flash hider aperture somewhere between the two ends. However, such designs deliver less torque to the flash hider than if the flash hider aperture were arranged on an end of the wrench. This challenge can be solved via use of a torque extender or a dedicated flash hider wrench, but this also entails the carrying of multiple tools, which is disadvantageous to military personnel in the field. Moreover, certain accessory end plates can significantly limit the utility of certain castle nut wrenches.

Thus, there exists a need for a wrench that can remedy the foregoing problems.

SUMMARY

The present disclosure relates generally to a wrench having apertures for removing and attaching particular components of an AR15/M16 type rifle or M4 type carbine, such as a castle nut, a flash hider, and a barrel nut.

In some aspects, a wrench for performing gunsmithing operations is provided, having a first end and a second end. The first end may have an aperture having a first castle nut interface shaped to engage a castle nut, a second castle nut interface shaped to engage the castle nut, and a flash hider interface. The first castle nut interface may have a substantially cylindrical wall section shaped to surround a portion of an outer surface of the castle nut, the cylindrical wall section having a plurality of raised elements extending inwardly for engaging a plurality of indentations in the castle nut. The second castle nut interface may have a substantially flat face, the flat face having a plurality of protrusions extending from the flat face for engaging the plurality of indentations in the castle nut.

In some aspects, a wrench for performing gunsmithing operations is provided, having a first end having an integrated two-sided castle nut and flash hider wrench aperture. The aperture may have a plurality of raised elements for engaging indentations in a castle nut, each of the raised elements extending at least one of inwardly from a wall section of the aperture and upwardly from a first face of the wrench. The aperture may also have a flash hider cutout portion. The wrench may have a second end with a tool interface.

In some aspects, a wrench for performing gunsmithing operation is provided, having a first end with an aperture and a second end. The aperture may extend through two faces of the wrench and have a plurality of raised elements for engaging indentations in a castle nut. The raised elements may extend at least one of inwardly from a substantially cylindrical wall section of the aperture and outward from one of the two faces of the wrench. The aperture may have a flash hider interface having two opposing walls.

DETAILED DESCRIPTION

The word "exemplary" is used herein to mean "serving as an example, instance, or illustration." Any embodiment described herein as "exemplary" is not necessarily to be construed as preferred or advantageous over other embodiments.

The present disclosure relates generally to a multi-purpose wrench for servicing a firearm. In particular, but not by way of limitation, the present disclosure relates to systems, methods and apparatuses for a wrench having apertures for removing and attaching particular components of an AR15/M16 type rifle or M4 type carbine, such as a castle nut, a flash hider, and a barrel nut, the apertures being optimally positioned for maximum torque at each element to be removed or attached.

Figure 1:
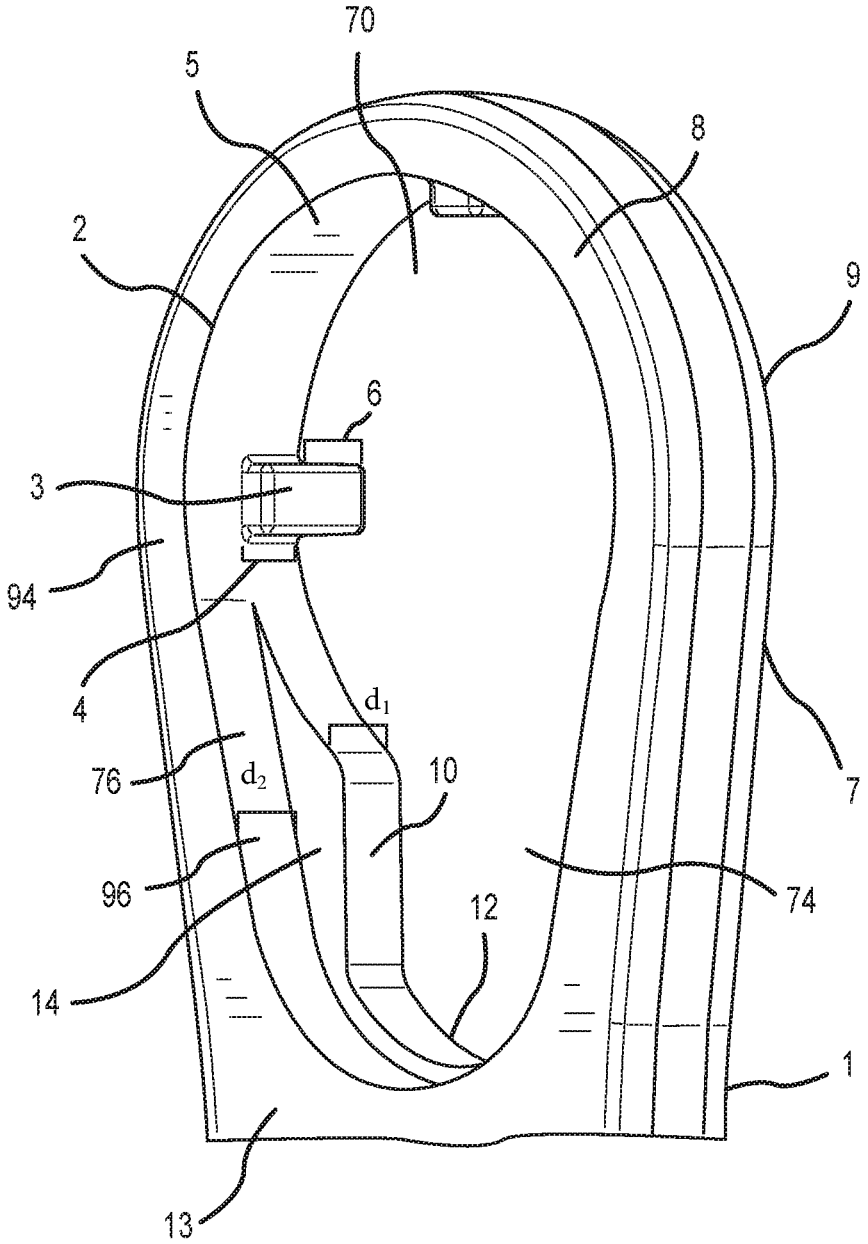
FIG. 1 is a front perspective view of one side of an integrated two-sided castle nut and flash hider aperture for a wrench.
Figure 2:
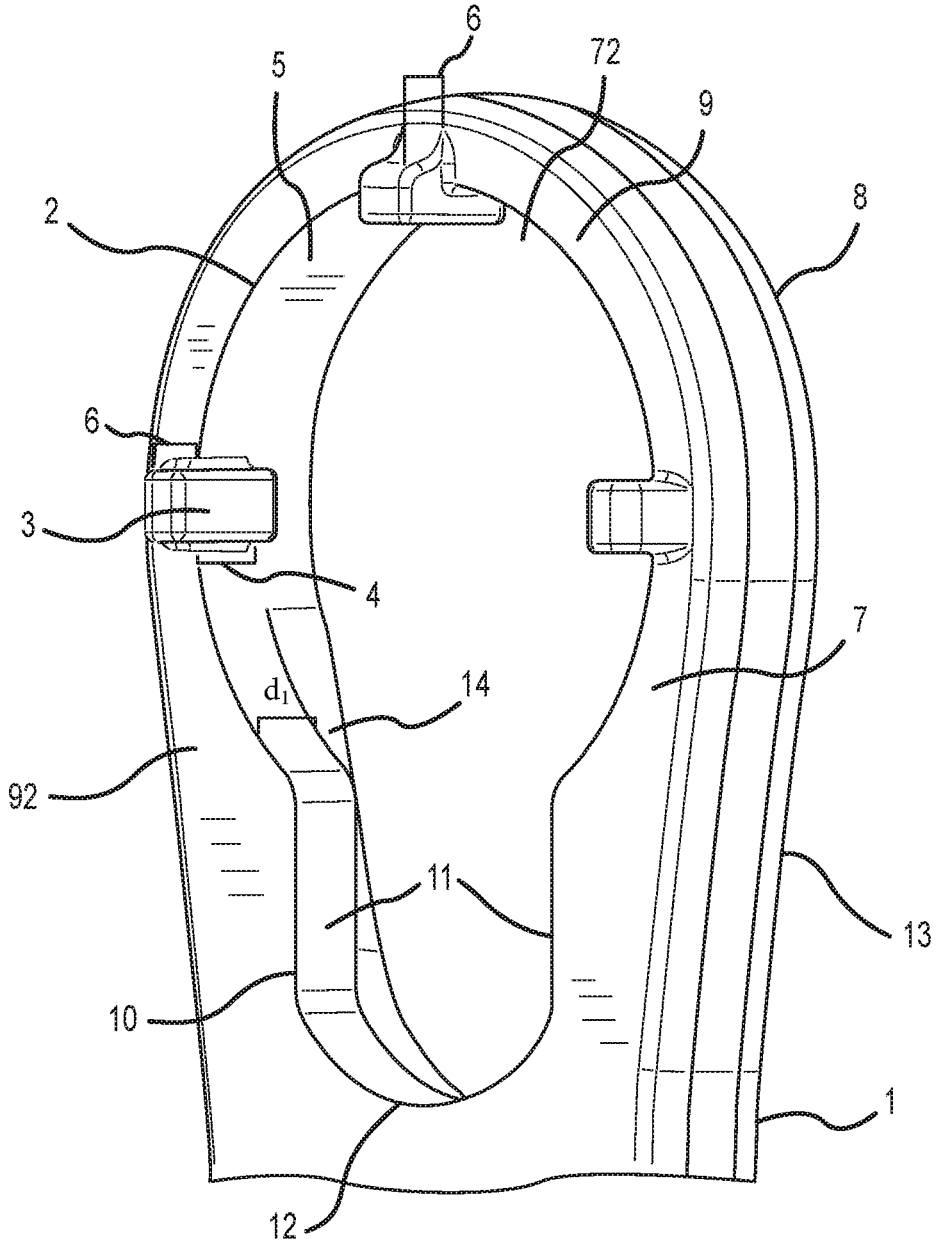
FIG. 2 is an opposing perspective view of the aperture of FIG. 1.
Figure 6:
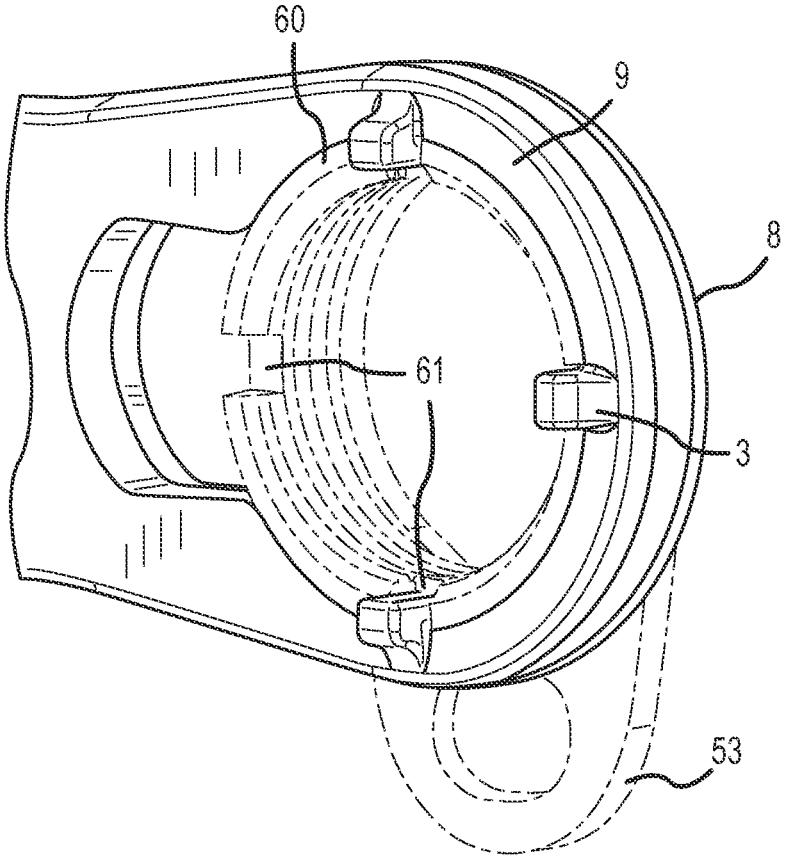
FIG. 6 is a close up, rear perspective view of the aperture engaged as in FIG. 5, showing the castle nut and end plate.

Referring to FIGS. 1 and 2, shown is a wrench body 1 containing an integrated two-sided castle nut and flash hider wrench aperture 2, which may be referenced herein simply as an "aperture." The aperture 2 comprises a plurality of prongs 3 that are sized to fit within the four indentations 61 of castle nut 60, as seen in FIG. 6. The prongs 3 each have a raised element 4 which is affixed to an aperture socket interior 5 (see e.g. FIG. 7). The prongs 3 each also have protruding sections 6 which protrude beyond the aperture socket interior 5, and are substantially perpendicular to a face 7 of the aperture 2. For reasons that will become apparent later in the disclosure, the sides of the aperture 2 are referred to herein as surround side 8 and protrusion side 9. Alternatively, they may be referred to as a front side 8 and a back side 9. The front side 8 has a face 13 and the back side 9 has a face 7.

Continuing with FIGS. 1-2, the wrench may include an upper side 92 and a lower side 94. A flash hider interface 74 may be positioned on one of the upper side 92 or the lower side 94. A receiver end plate interface 96 may be positioned adjacent the flash hider interface 74 on the other one of the upper side 92 or the lower side 94.

A first castle nut interface 70 is most clearly illustrated in FIG. 1. The first castle nut interface 70 may have a substantially cylindrical wall section shaped to surround a portion of an outer surface of the castle nut, with the cylindrical wall section having a number of prongs 3 or raised elements 4 extending inwardly for engaging a number of indentations in the castle nut. A second castle nut interface 72 is illustrated most clearly in FIG. 2. The second castle nut interface 72 may have a substantially flat face such as face 7, with a number of prongs 3 or protrusions, such as protruding sections 6, extending from the flat face for engaging a number of indentations in the castle nut. In some embodiments, raised elements 4, prongs 3, and protruding sections 6 may be formed by a unitary feature.

It should also be understood that, although the raised elements 4, prongs 3, and protruding sections 6 are all located at the same orientation, in some embodiments, the protruding sections 6 may be "rotated" relative to the raised elements 4. That is, the protruding sections 6 may extend from the wrench at different points than do the raised elements 4. It should also be understood that although sets of three each are illustrated, it is not required that the wrench have an equal number of sets. For example, the wrench may have two raised elements 4 and three protruding sections 6, or vice versa, or any suitable number of raised elements 4, prongs 3, and/or protruding sections 6.

Still referring to FIGS. 1 and 2, the aperture 2 has a flash hider cutout section 10 that is shaped and sized to fit a flash hider which is comprised of flat sections 11 and rounded section 12. The distance between the flat sections 11 is approximately 0.75 inches, which is a standard size for commercially available flash hiders, but can comprise any distance needed to fit a given non-standard flash hider, muzzle break, blast diffuser, sound suppressor, other muzzle accessories and/or other calibers. The rounded section 12 is designed to closely engage a third side of a flash hider, providing additional contact surface area as compared to a standard wrench or a flash hider wrench without such a rounded section. It should be understood that the rounded section 12 need not extend completely between each of the flat sections 11. For example, in some embodiments, the flash hider may engage the flash hider cutout section 10 at two walls and a rounded section, with gaps between the engagements with these features.

Figure 9:
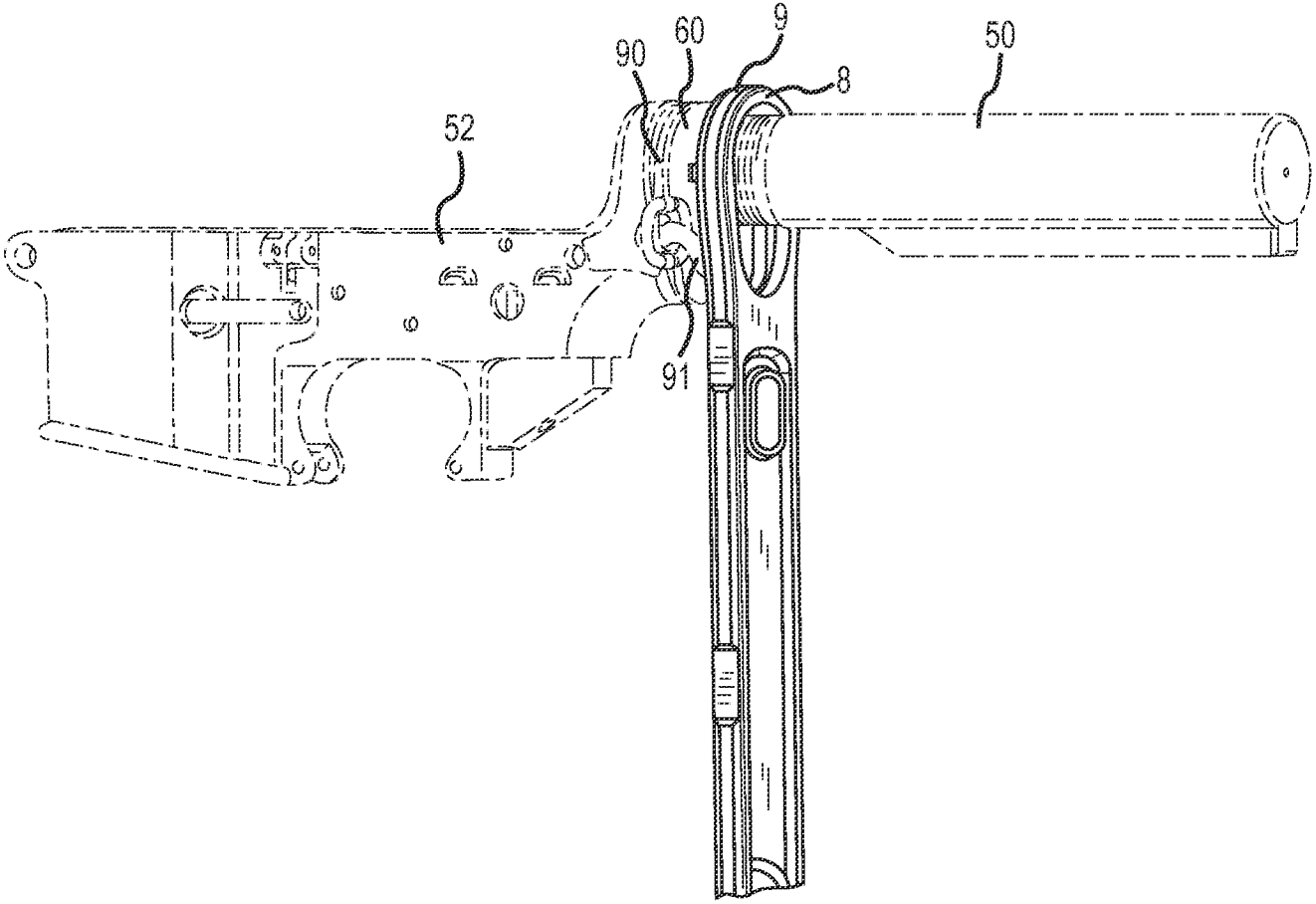
FIG. 9 is a front perspective view of the aperture engaged with a castle nut along with some components of a weapon.

An additional benefit of the width between the flat sections 11 is that it is greater than the width of a rectangular longitudinal protrusion 51 on a buffer tube or receiver extension 50 seen in FIG. 9. The flash hider cutout section 10, therefore, allows for the aperture 2 to slide over the receiver extension 50 without hindrance from the rectangular protrusion at a bottom of the receiver extension 50. Cutouts that enable the user to slide wrenches over receiver extensions are known in the art. However, no known cutouts are designed to both slide over the rectangular protrusion at a bottom of the receiver extension 50 and to couple to a flash hider.

Still referring to FIGS. 1 and 2, in some embodiments, the flash hider cutout 10 is flush with the face 7 of the protrusion side 9. On the surround side 8, there is an optional recessed step 14 between the face 13 and the flash hider cutout 10. The optional recessed step 14 can accommodate various flash hider designs. For example, some flash hiders have diameters abutting the flat surfaces that are greater than the width of the circular surfaces on both sides of the flat surfaces.

In some embodiments, the recessed step 14 provides a receiver end plate interface designed to drive a carbine receiver extension. To give the reader some background, it is noted that the carbine receiver extension, the receiver end plate (which is keyed to the receiver extension), and the castle nut are installed and/or removed as a group as the extension is threaded into the receiver. While this can usually be done by hand, there are occasions in which additional torque may be required. In those cases, a user can cause the recessed step 14 to engage the receiver end plate to rotate the group of three parts into place. Additionally, most flash hiders have flat engagement areas that are not as far apart from each other as the diameter of other portions of the flash hider. The recessed step 14 provides clearance for the greater diameter sections of such flash hiders while providing an appropriate width between the flat sections 11 to engage the flash hider.

Figure 3:
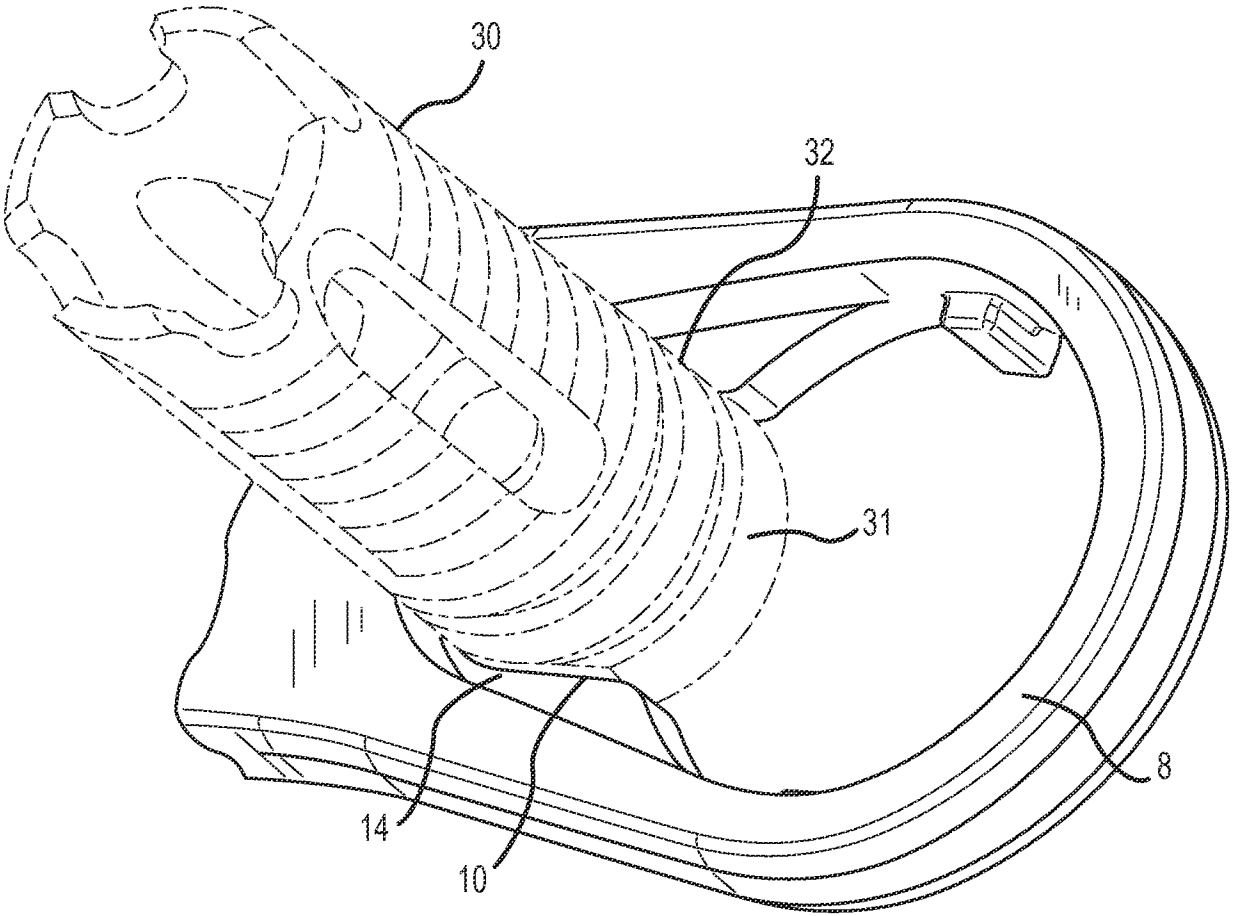
FIG. 3 is a front perspective view of the aperture of FIG. 1 engaged with a flash hider.
Figure 4:
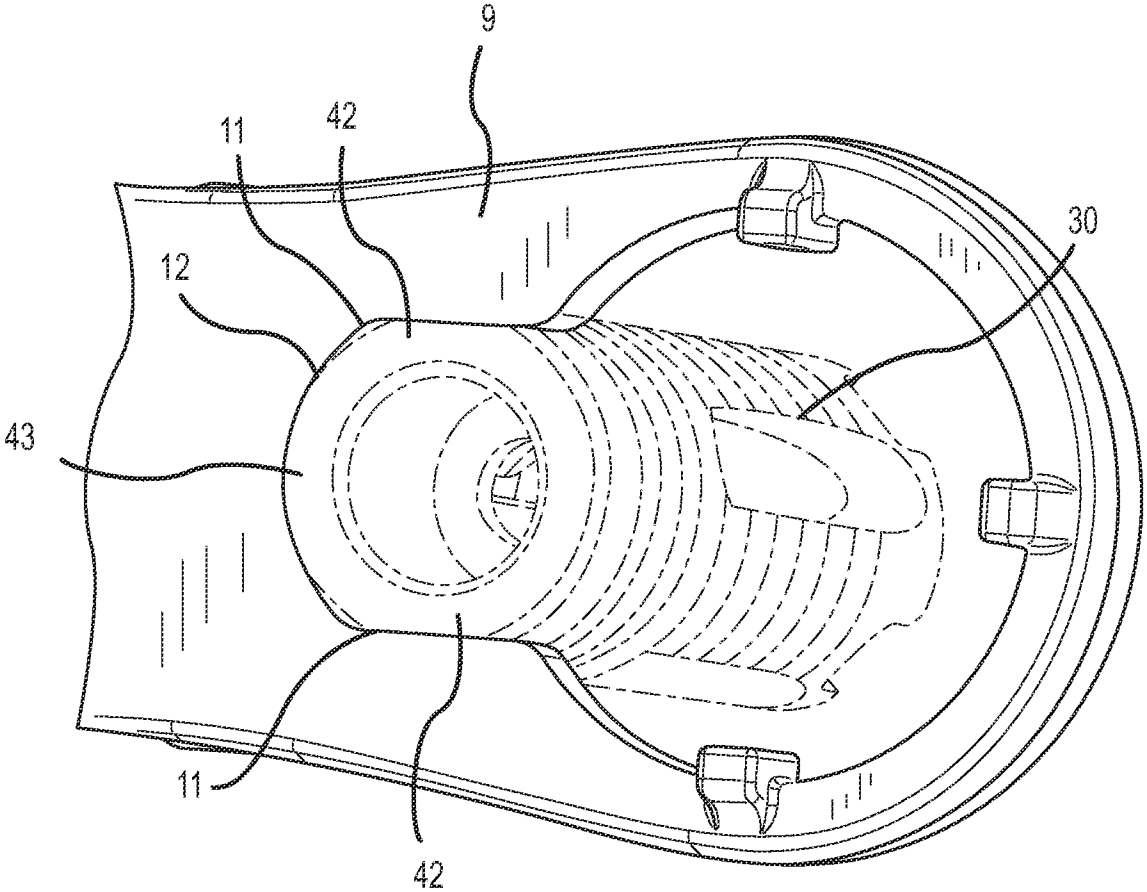
FIG. 4 is a rear perspective view of the aperture of FIG. 1 engaged with a flash hider.

FIGS. 3 and 4 show opposing views of the aperture 2 engaged with a flash hider 30 via the flash hider cutout 10. The flash hider 30 in these figures has flat engagement edges 42 and round engagement edge 43. The flat engagement edges 42 engage with the flat sections 11, and the round engagement edge 43 engages with the rounded section 12, so the flash hider 30 is engaged on three edges. This is preferable to engaging a flash hider on only two edges and prevents slipping. In the illustrated embodiment, the flash hider 30 also has flat engagement edge width 31 that is approximately the same width as flash hider cutout 10, although this width is not required. In other embodiments, the width of the flash hider cutout 10 can be greater or less than the flat engagement edge width 31. In the illustrated embodiment, the flash hider 30 also has a diameter 32 that is slightly wider than the 0.75" width of flash hider cutout 10 on the side that is pointed toward the surround side 8. That is, the diameter 32 is slightly greater that the distance between the outermost edges of the two flat engagement edges 42. Also in the illustrated embodiment, this diameter 32 only exists on one side of flat engagement edges 42—on the side pointed toward front side 8. It is to be understood that other types of flash hiders have diameters wider than 0.75" on both sides of flat engagement edges 42 along the longitudinal axis of the flash hider 30, i.e., on the sides pointing towards the front side 8 and the back side 9, which is one reason that the recessed step 14 is beneficial.

Continuing with FIGS. 1-4, the aperture 2 may have a flash hider interface 74. The flash hider interface 74 may have a flash hider cutout section 10 that extends from one of the faces 7, 8 to a first depth of a stepped passage, and a clearance portion 76 extending from the flash hider cutout section 10 through the other one of the faces 7, 8. In some embodiments, the flash hider cutout section 10 may extend all the way through the wrench, from one face 7, 8 through another face 7, 8.

Figure 5:
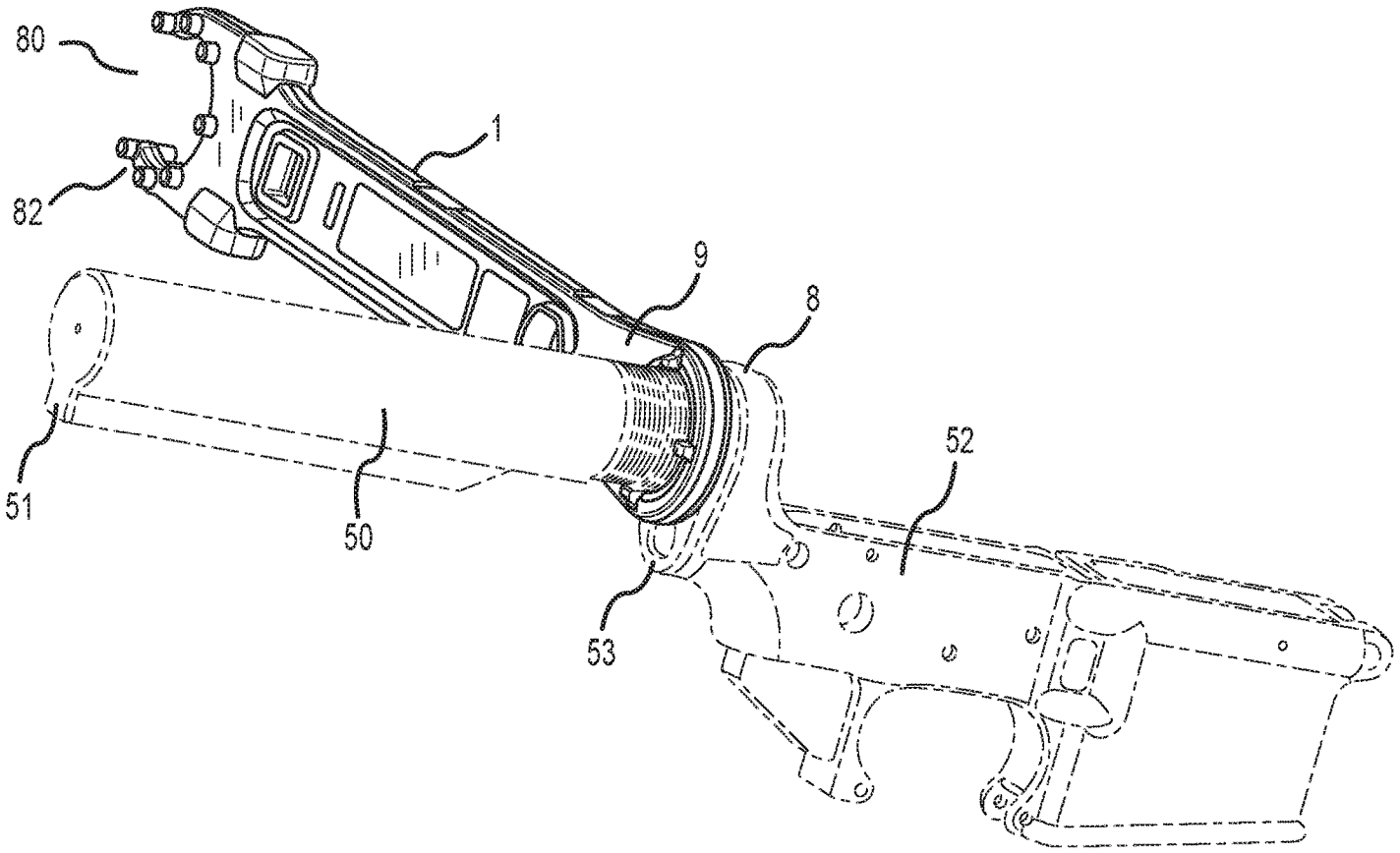
FIG. 5 is a rear perspective view of the aperture of FIG. 1 on a wrench, engaged with a castle nut on a weapon.
Figure 7:
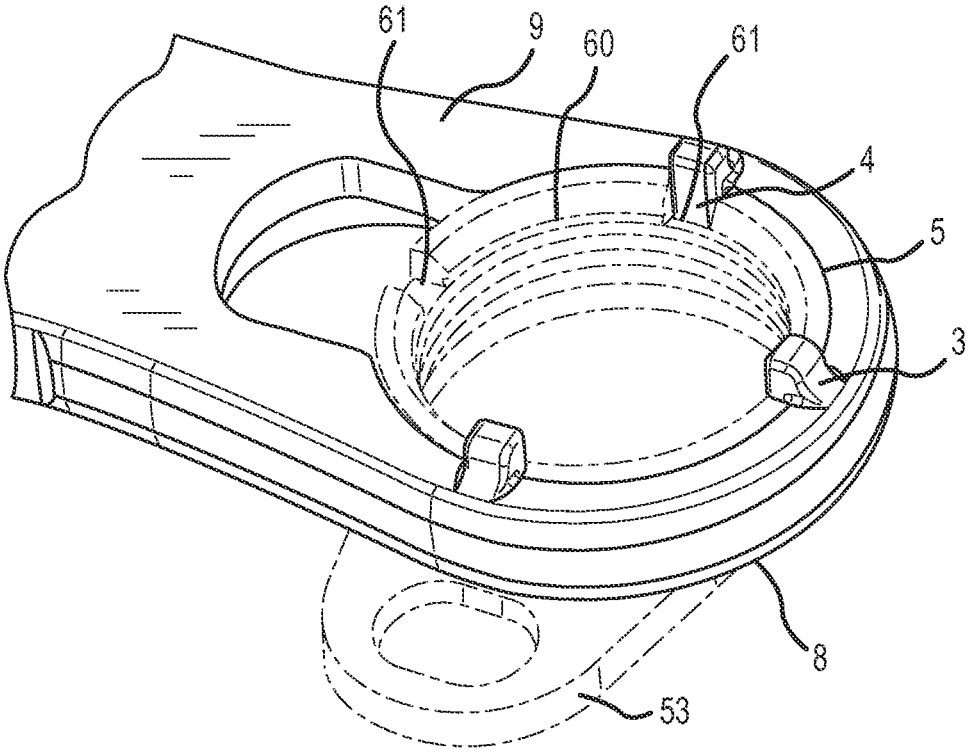
FIG. 7 is a close up, bottom perspective view of the aperture engaged as in FIG. 6, showing the aperture engaged with the castle nut.
Figure 8:
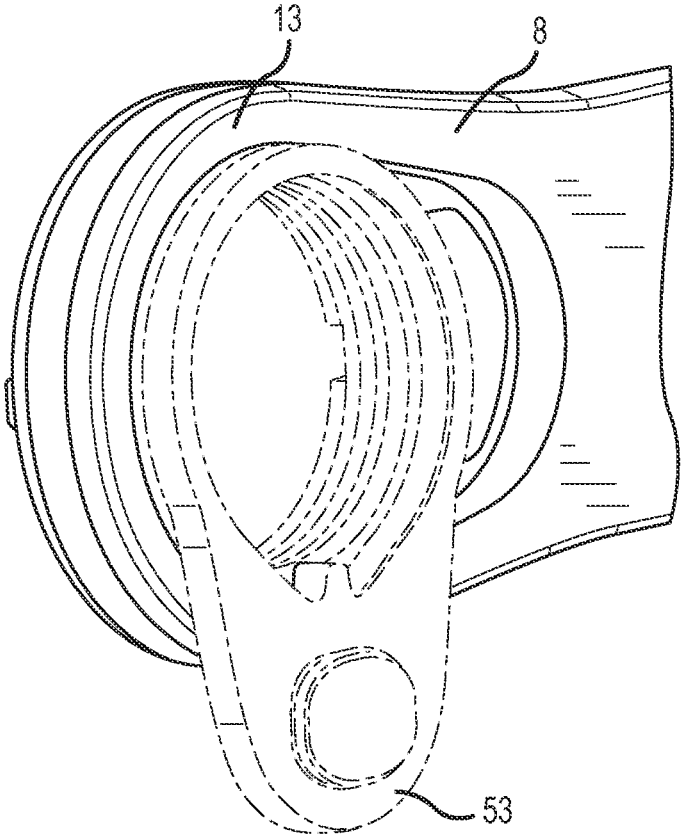
FIG. 8 is a close up, front perspective view of the aperture as engaged in FIG. 5, particularly showing a flush engagement with the end plate.

Referring to FIGS. 5, 6, 7, and 8, shown is the aperture 2 engaged with the castle nut 60 on the surround side 8. FIG. 5 shows the wrench 1 engaged with a partially assembled weapon, including carbine buffer tube or carbine receiver extension 50, lower receiver 52, and end plate 53. The end plate 53 is substantially flat on the rear surface facing the wrench 1, and in some embodiments may be a standard CAR-15 or M4 type end plate. FIG. 7 shows how three of castle nut indentations 61 are engaged with the raised elements 4 of the prongs 3. Additionally, the aperture socket interior 5 surrounds a majority of a circumference of the castle nut 60 in a mostly enclosed circle. This provides contact surface area beyond just the surface between the raised elements 4 and castle nut indentations 61. As shown in FIG. 8, from the front (surround) side 8, the face 13 is substantially flush with the end plate 53. This engagement configuration is possible because the end plate 53 is substantially flat. This engagement configuration is beneficial for providing maximum contact surface area, which decreases the likelihood of slipping.

Figure 10:
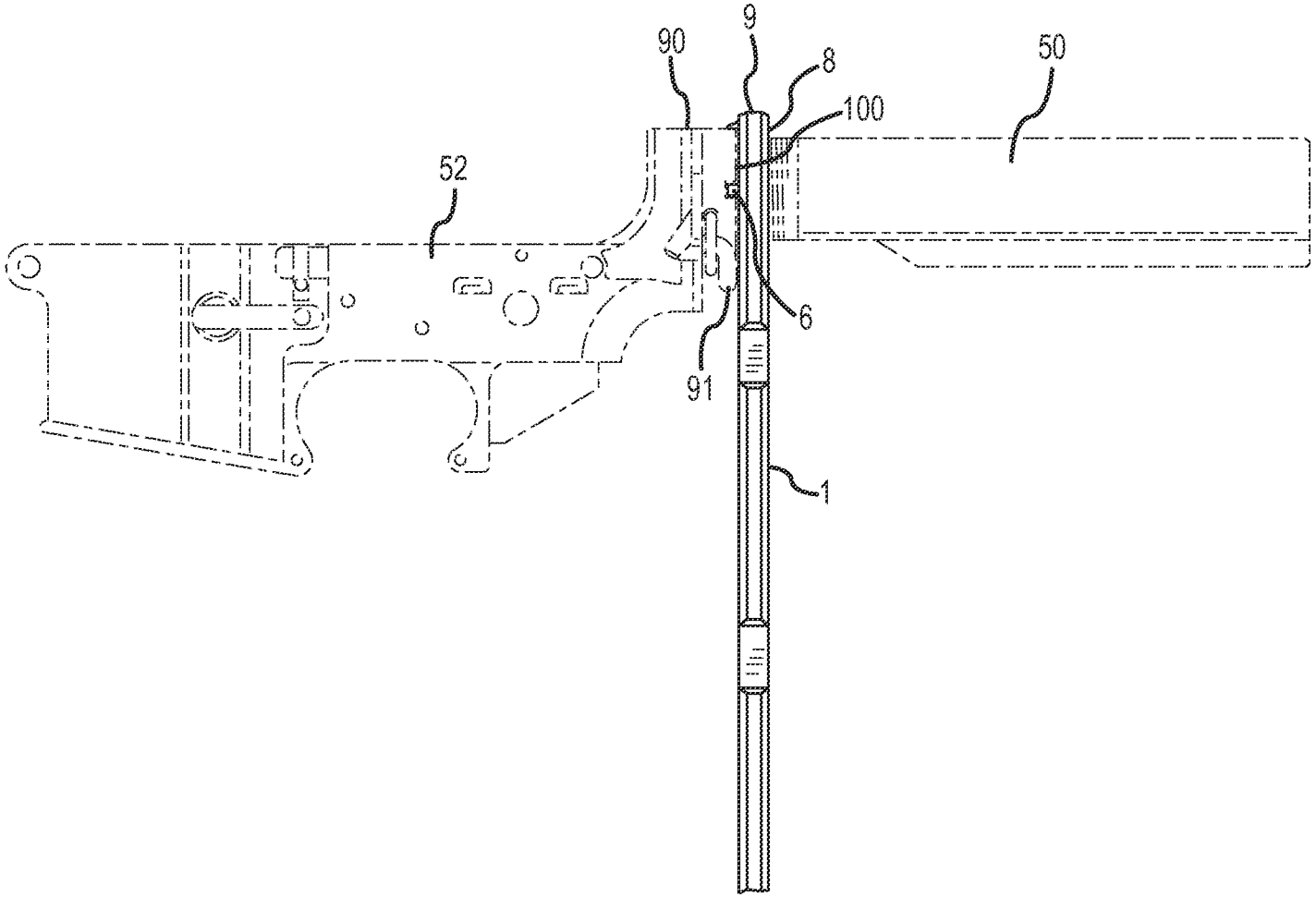
FIG. 10 is a side view of the aperture as engaged in FIG. 9.
Figure 11:
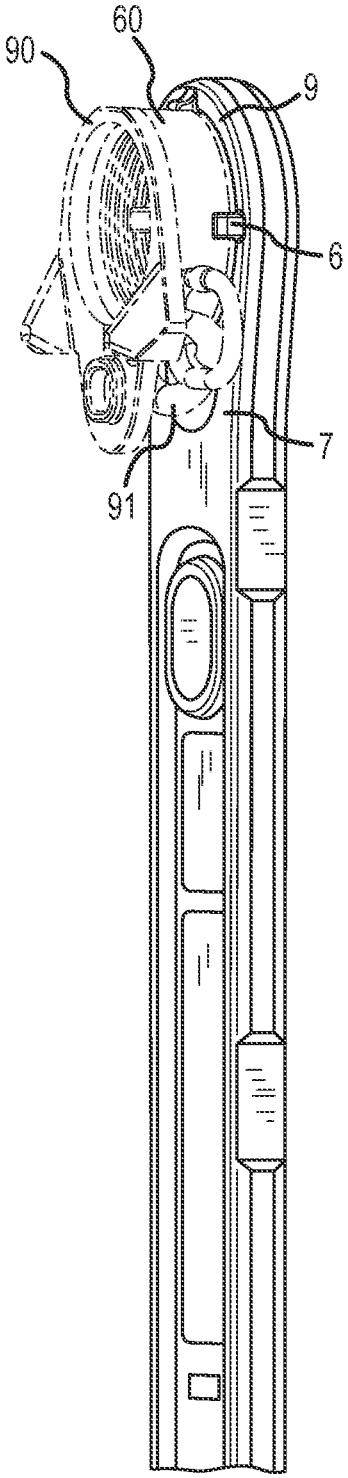
FIG. 11 is a rear perspective view of the aperture as engaged in FIG. 9, showing the castle nut and the accessory adapter end plate.

FIGS. 9, 10, and 11 show the wrench 1 engaged with the castle nut 60 on the protrusion side 9. FIG. 9 is a rear perspective view including a partially assembled weapon with the carbine buffer tube or carbine receiver extension 50, the castle nut 60, the accessory end plate 90, and the lower receiver 52. Some embodiments of an accessory end plate 90 are described in detail in commonly-assigned U.S. Pat. No. 8,596,504, the entire contents of which are incorporated herein by reference. FIG. 10 is a side view of FIG. 9, which shows that the accessory end plate 90 has an accessory attachment area 91 which extends past the depth of a standard receiver end plate, and nearly the depth of castle nut 60. The accessory attachment area 91 makes it difficult to engage the castle nut 60 with currently-available partially surrounded castle nut wrenches, which also limit the amount of rotation the wrench can provide with a single stroke. In the case of fully-surrounded designs, the accessory attachment area 91 makes it generally impossible to engage and rotate the castle nut 60 with the surround side 8 of the aperture 2, or with any castle nut wrench which surrounds the castle nut in whole or in part. In the illustrated embodiment, the particular accessory attachment area 91 has a bar to which a sling for a firearm can be attached. This bar protrudes from the end of the accessory end plate 90 out towards the receiver extension 50, which would impede the rotation of a wrench that surrounds the outer circumference of the castle nut. To overcome this challenge, the protruding sections 6 of the prongs 3 engage the castle nut indentations 61 rather than an entire arced aperture of a wrench enveloping the castle nut. In this way, the face 7 of protrusion side 9 sits flush with a rear face 100 of the castle nut 60, and wrench 1 can rotate without impinging on the bar of the accessory attachment area 91 (see also FIG. 11).

As most clearly illustrated in FIG. 5, the wrench may include a second end. As shown, the second end may be or have a tool interface 80. The tool interface 80 may be a two-sided barrel nut interface 82, as shown, although those skilled in the art will readily recognize that only one side of the two-sided barrel nut interface 82 may be provided, so as to provide a single barrel nut interface.

The above descriptions show how a user could remove a factory-attached castle nut with surround side 8, as shown in FIGS. 5, 6, 7, and 8, and then install an accessory end plate and reattach the castle nut with the protrusion side 9, when rotation around the accessory end plate is necessary. Such a tool has become necessary with the recent advent of accessory end plates with depths extending to and beyond the rear face of the castle nut. The overall design described herein provides three tools with maximum functionality for each of their uses on one end of a wrench. By placing these three tools on the very end of a wrench, maximum torque for each tool is achieved.

The embodiment described herein allows the opposite end of the wrench to be available for one or more different firearm servicing tools. In one particular embodiment, the opposite end has two barrel nut wrenches. Two-sided barrel nut wrenches are known in the art. However, wrenches containing the two kinds of castle nut wrenches, plus the flash hider wrench, plus the two-sided barrel nut wrench, each feature being at the end of one wrench, are not known.

What is claimed is:

1. A wrench for performing gunsmithing operations, comprising:

a first end having an upper side, a lower side, and an aperture extending from the upper side to the lower side, the aperture having a first castle nut interface shaped to engage a castle nut, a second castle nut interface shaped to engage the castle nut, a flash hider interface shaped to engage a flash hider, arranged on one of the upper or lower side, and comprising two opposing and parallel flat inner walls each defining a step arranged between the flash hider interface and a receiver end plate interface positioned on the other one of the upper or lower side and having a shape substantially following an outline of a receiver end plate, wherein the first castle nut interface, the second castle nut interface, the flash hider interface, and the receiver end plate interface each share the aperture; and a second end; wherein the first castle nut interface comprises a substantially cylindrical wall section shaped to surround a portion of an outer surface of the castle nut, the cylindrical wall section having a plurality of raised elements extending inwardly from an interior of the cylindrical wall section for engaging a plurality of indentations in the castle nut; and wherein the second castle nut interface comprises a substantially flat face on the upper side, the flat face having a plurality of protrusions extending from the plurality of raised elements upwardly from the flat face for engaging the plurality of indentations in the castle nut; and the receiver end plate interface is shaped as a rounded, oblong aperture having a first wide end and a second narrow end.

2. The wrench of claim 1, wherein:

the second end comprises a barrel nut interface shaped to engage a majority of an outer circumference of a barrel nut.

3. The wrench of claim 1, wherein:

the second end comprises a two-sided barrel nut interface shaped to engage a majority of an outer circumference of at least one barrel nut.

4. The wrench of claim 1, wherein the flash hider interface comprises a curved surface between the two opposing and parallel flat inner walls.

5. The wrench of claim 1, wherein the flash hider interface extends a first depth into the wrench, and the receiver end plate interface extends a second depth into the wrench.

6. The wrench of claim 5, wherein the first and second depths are the same.

7. A wrench for performing gunsmithing operations, comprising:

a first end having an upper side having a first face, a lower side, an integrated two-sided castle nut wrench portion, a flash hider wrench portion, and a receiver end plate interface, the wrench having an aperture extending through the upper side and the lower side, the aperture being shared by the two-sided castle nut wrench portion, the flash hider wrench portion, and the receiver end plate interface, the aperture having a plurality of raised elements for engaging indentations in a castle nut, each of the raised elements extending both inwardly from an interior of a wall section of the aperture and upwardly from the first face of the wrench, the flash hider wrench portion having two opposing and parallel flat inner surfaces each defining a step arranged between the flash hider interface and the receiver end plate interface, the receiver end plate interface positioned on an opposing one of the upper or lower side of the first end from the flash hider wrench portion and having a shape substantially following an outline of a receiver end plate, and the receiver end plate interface is a rounded, oblong aperture having a first wide end and a second narrow end; and a second end having another wrench interface.

8. The wrench of claim 7, wherein:

the another wrench interface in the second end comprises a two-sided barrel nut interface shaped to engage a majority of an outer circumference of at least one firearm barrel using two different orientations of the wrench.

9. The wrench of claim 7, wherein:

the flash hider wrench portion has a curved portion positioned between the two opposing and parallel flat inner surfaces.

10. The wrench of claim 7, wherein the flash hider wrench portion extends a first depth into the wrench, and the receiver end plate interface extends a second depth into the wrench.

11. The wrench of claim 10, wherein the first and second depths are the same.

12. A wrench for performing gunsmithing operations, comprising:

a first end having an aperture, the aperture extending through two faces of the wrench and having a plurality of raised elements for engaging indentations in a castle nut, the raised elements extending both inwardly from an interior portion of a substantially cylindrical wall section of the aperture and outward from one of the two faces of the wrench, the aperture further having a flash hider interface having two opposing and parallel inner walls defining a step arranged between the flash hider interface and a receiver end plate interface the receiver end plate interface comprising an oblong shape having a first wide end and a second narrow end, the flash hider interface and the receiver end plate interface extending into the aperture from opposing ones of the two faces of the wrench, wherein the aperture is shared by the receiver end plate interface and the flash hider interface; and a second end.

13. The wrench of claim 12, wherein:

the second end of the wrench comprises a two-sided barrel nut interface shaped to engage a majority of an outer circumference of at least one barrel nut.

14. The wrench of claim 12, wherein:

the flash hider interface extends from one of the two faces of the wrench to a first depth of the aperture.

15. The wrench of claim 12, wherein:

the flash hider interface has a semicircular portion shaped to engage a rounded surface on the flash hider.

16. The wrench of claim 14, wherein:

the two faces of the wrench comprise a first face and a second face;

the flash hider interface extends to the first depth of the aperture from one of the first face and the second face; and the aperture comprises a clearance portion shaped to engage a receiver end plate and to allow the flash hider to clear the clearance portion when the flash hider is engaged with the flash hider interface.

* * * * *